US005263749A

United States Patent [19]

Errani

[11] Patent Number: 5,263,749

[45] Date of Patent: Nov. 23, 1993

[54] LOCK WITH AN EMERGENCY OPENING DEVICE

[75] Inventor: Deo Errani, Faenza, Italy

[73] Assignee: Costruzioni Italiane Serrature Affini C.I.S.A. S.p.A., Faenza, Italy

[21] Appl. No.: 950,565

[22] Filed: Sep. 25, 1992

[30] Foreign Application Priority Data

Oct. 1, 1991 [IT] Italy ..... BO91A000349

[51] Int. Cl.[5] ..... E05B 3/00

[52] U.S. Cl. ..... 292/40; 292/245; 292/DIG. 60; 292/DIG. 61

[58] Field of Search ..... 292/40, 244, 245, 336.3, 292/DIG. 60, DIG. 61

[56] References Cited

U.S. PATENT DOCUMENTS

| | | | |
|---|---|---|---|
| 314,738 | 3/1885 | Sparks | 292/245 |
| 3,999,789 | 12/1976 | Orville | 292/34 |
| 4,925,222 | 5/1990 | Look | 292/DIG. 61 X |
| 4,941,695 | 7/1990 | Miller | 292/DIG. 60 X |

FOREIGN PATENT DOCUMENTS 0378124 12/1976 European Pat. Off. .

*Primary Examiner*—Richard E. Moore

*Attorney, Agent, or Firm*—Guido Modiano; Albert Josif

[57] ABSTRACT

Lock comprising a spring-latch and a bolt, the spring-latch being actuatable against the biasing action of a spring by means of an external lever (knob) or an internal lever (handle), the levers being rotationally rigidly coupled to respective coaxial hubs rotatably supported at the sides of an element for opening the spring-latch which is pivoted coaxially to the hubs and is intermediate thereto; the lock further comprises teeth for pulling the element defined on the hubs, the teeth being able to pull the element only in the direction for opening the spring-latch by actuating one of the levers, a spring for the elastic return of the hubs when the levers are released which acts on tabs of the hubs with the interposition of a block guided tangentially to the hubs; the block can be orientated and is shaped so as to provide abutment only to the tab of the hub to which the inner lever is rigidly coupled.

3 Claims, 4 Drawing Sheets 1
2
3
4
8
9
10
29
30
51
52
57
58
73
76

LOCK WITH AN EMERGENCY OPENING DEVICE

BACKGROUND OF THE INVENTION

The present invention relates to various improvements in recessed locks comprising a spring-latch and a bolt and provided with an emergency opening device.

Normally, in locks of the described type an inner handle and an outer knob are provided for the actuation of the spring-latch, whereas a key-operated cylinder is provided for the actuation of the bolt and can be replaced with a pushbutton device on the inside and with an electromagnetic release device on the outside.

However, in some cases, for example in the case of hotels, the possibility of simultaneously removing the spring-latch and the bolt from their locking position by acting from inside only on the spring-latch actuation handle is required. This need is imposed by safety reasons, in order to allow anyone who is locked in a room to rapidly exit when the necessary calm may be lacking, for example when a hazardous situation (fire) occurs, without having to first unlock the bolt with the key or pushbutton.

In locks which comply with these requirements (one of these is described, for example, in European Patent application No. 90100205.5 filed Jan. 5, 1990 by the same applicant), in order to prevent the actuation of the spring-latch from outside as well, the hub of the knob is disconnected from the hub of the handle.

In this manner it is possible to actuate only the spring-latch when the outer knob is actuated, whereas by actuating the inner handle both the spring-latch and the bolt are actuated.

Known locks with emergency opening have some constructive and operating problems.

First of all, the return force which restores the knob and the handle to their inactive position after actuation is obtained by means of the compression of the same spring. Consequently, considering that the knob offers a shorter lever arm than the handle, actuation of the knob entails a greater physical effort which is hardly negligible also in view of the fact that the spring must return to the inactive position the handle as well as all the other elements connected thereto that transmit the movement to the bolt.

Secondly, there is the need to modify the lock in order to make it suitable for doors which open inward or outward and in which not only the knob and the handle reverse their position but it is necessary to maintain the connection between the handle and the bolt in this reversed position.

SUMMARY OF THE INVENTION

The technical aim of the present invention is therefore to provide improvements in locks with emergency opening which allow to reduce the force for the actuation of the knob regardless of the side of the lock o which it is applied.

Within the scope of this aim, an object of the present invention is to provide a lock wherein the bolt can be connected only to the handle, regardless of the side of the lock on which said handle is applied.

This aim and this object and others which will become apparent hereinafter are achieved by means of a lock as defined in the appended claims.

BRIEF DESCRIPTION OF THE DRAWINGS

Further particulars of the present invention will become apparent from the following description of a preferred embodiment, illustrated only by way of non-limitative example in the accompanying drawings, wherein.

DESCRIPTION OF THE PREFERRED EMBODIMENTS

Figure 1:
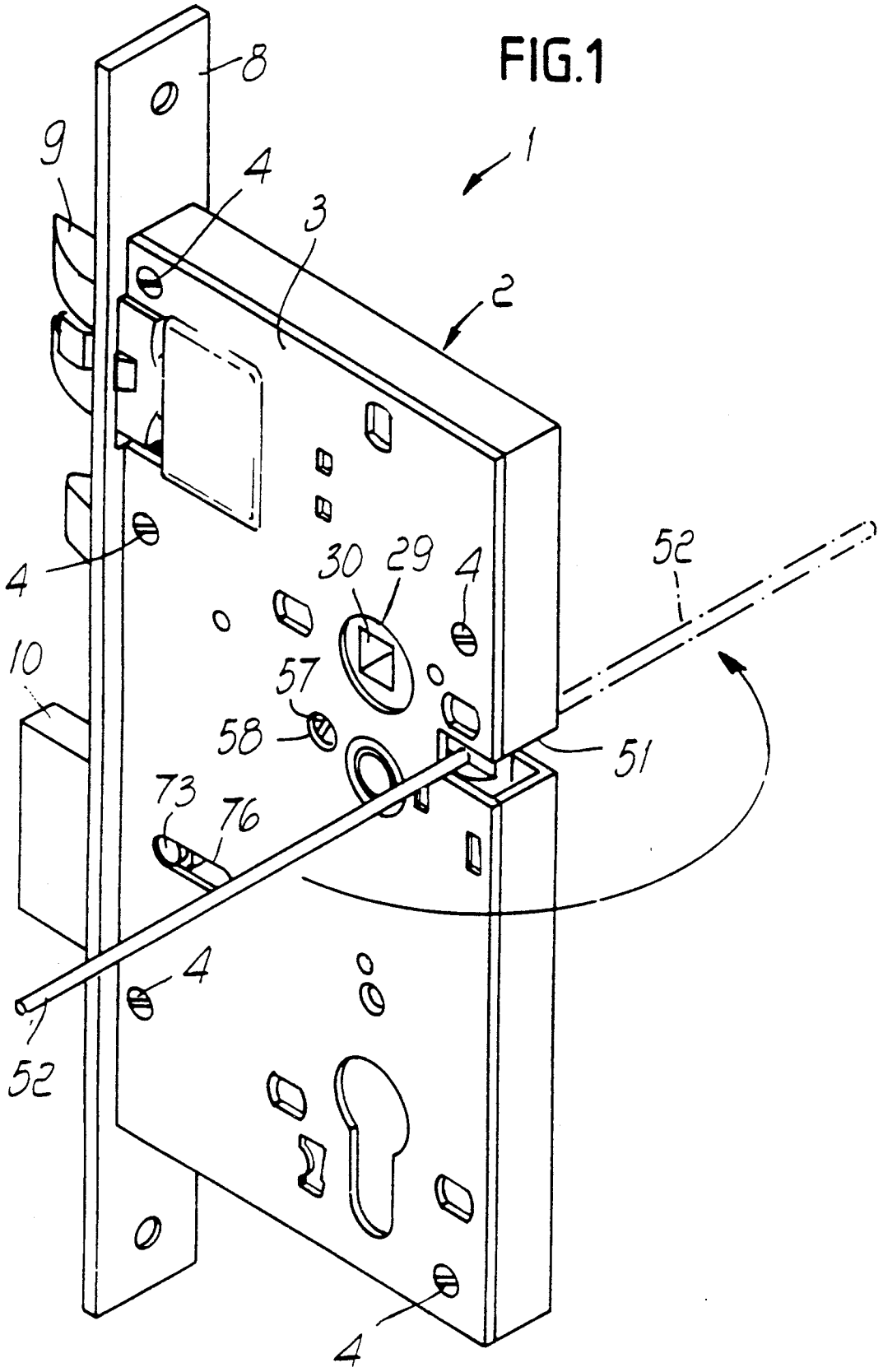
FIG. 1 is a perspective view of the lock according to the present invention.

In the figures, the lock is generally designated by the reference numeral 1.

Said lock comprises a case 2 for containing the various elements which has a flattened rectangular prism-like shape. The case 2 is closed by a cover 3 fixed by means of screws 4 which engage in respective bushes 5 fixed to the bottom 6 and in the proximity of the front side of the perimetric wall 7 of the case which rises from the bottom 6.

The case 2 is inserted in a seat of the door and is fixed by means of a front plate 8 which closes said seat.

The lock comprises a spring-latch 9 and a bolt 10 which engage respective seats of the doorjamb when the door is closed.

The spring-latch 9 has a stem 11 on which a spring 12 is mounted; said stem is guided into a support 13 which rises from the bottom 6. The spring 12 acts between the support 13 and the spring-latch 9, so as to push said spring-latch outward. The spring-latch stop position is set by the abutment of a wing 14 mounted on the stem and axially retained by a ring 15. The wing 14 abuts on the support 13 with a portion 16 which is folded at right angles and is adjacent to the bottom 6, so that between the wing 14 and the support 13 there remains a space where the end of a lever 17, which constitutes the element for opening the spring-latch 9, enters.

Figure 3:
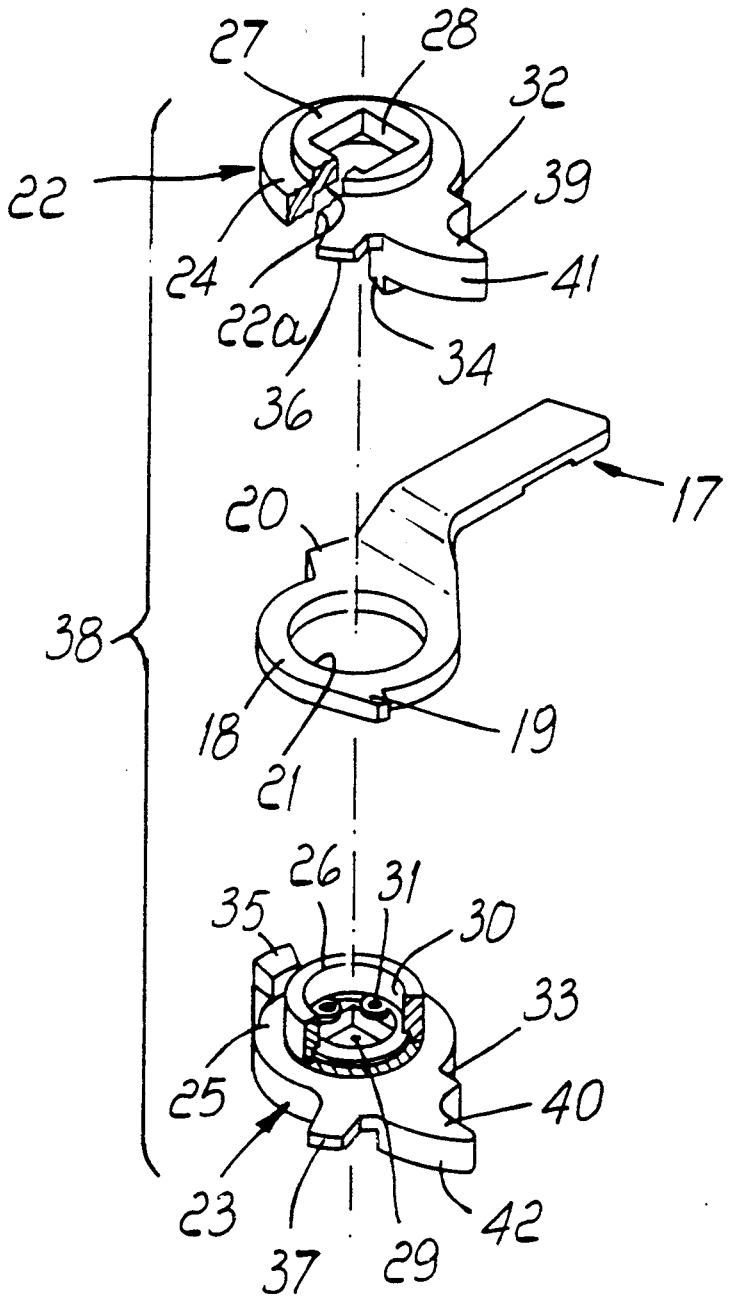
FIG. 3 is an exploded perspective view of the hubs and of the intermediate opening element.

As more clearly shown in FIG. 3, the lever 17 comprises a disk-like portion 18 on which two substantially diametrical teeth 19 and 20 are defined peripherally and a circular hole 21 is defined at the center.

Two respective hubs 22 and 23, constituted by disk-like elements 24 and 25, are associated with the opposite faces of the portion 18, the second one being adjacent to the bottom 6 and with a cylindrical collar 26 at its center. The collar 26 engages in the hole 21 so as to act as a pivot for lever 17, and its height is greater than the thickness of the disk-like portion 18. In this manner, the end of the collar 26 protrudes beyond the portion 18 in order to accommodate in a cylindrical seat **22*a* defined in the corresponding face of the hub 22**.

The hubs 22 and 23 have, on the side opposite to the lever 17, circular protrusions 27 (only the protrusion of the hub 22 is visible in the figure) which rotationally occupy respective seats of the bottom 6 and of the cover 3. The hubs 22 and 23 ar therefore rotatably supported in the case of the lock, whereas the lever 17 is rotatably supported between the hubs 22 and 23 on the collar 26. The hubs 22 and 23 are crossed by square holes 28 and 29 which are coaxial to the protrusions 27 and are suitable to receive the square pins of the lock actuation levers (the inner one and the outer one). In practice, the inner lever, i.e. the one meant to open the lock from the inside of a room, is constituted by a handle, whereas the outer one is, more frequently, constituted by a knob (ball).

It should be noted that the square pins of the handle and of the knob are distinct, and therefore the hubs 22 and 23 can be rotated independently of one another. In order to prevent the pin of the handle or knob inserted in the hole 28 from engaging prismatically in the hole 29, a cylindrical cavity 30 is defined in the collar 26, and a ring 31 which partially closes the hole 29 is arranged in the bottom of said cavity. In this manner, if a pin protrudes beyond the hole 28, it can freely rotate in the cavity 30, preventing the rotational coupling of the hubs.

The hubs 22 and 23 are peripherally provided with respective shoulders 32 and 33 and with respective teeth 34 and 35 which protrude from the surface which is adjacent to the portion 18 in order to interfere with the teeth 19 and 20. The hubs 22 and 23 are provided with further abutments 36 and 37 for the rapid actuation (retraction) of the bolt 10 simultaneously with the spring-latch by means of a device generally designated by the reference numeral 38.

The hubs 22 and 23 are furthermore provided with two tabs 39 and 40 which are beak-shaped and extend radially proximate to the shoulders 32 and 33. The tabs 39 and 40 have an edge 41 and 42 which constitutes a resting surface for elastic means 43 which keep the shoulders 32 and 33 adjacent to an abutment 44 which is fixed to the bottom 6 of the case.

The elastic means 43 are constituted by a cylindrical spring 45 which acts on a block constituted by a small cylinder 46 whose axis is perpendicular to the spring-latch sliding axis.

The spring 45 and the small cylinder 46 are slidingly accommodated in a recess defined by a plate 47 which is folded so as to form a bracket and which is rigidly coupled to the bottom 6 of the lock. The spring 45 rests on the bridge which joins the two parallel portions of the bracket, which guide the small cylinder. The top of the small cylinder 46 is chamfered through half of its thickness, so as to form a lug 48 flanked by a chamfer 49 and is able to accommodate only one of the two tabs 39 and 40, the other tab being aligned with the chamfer 49.

In the case closure condition, the small cylinder 46 is guided not only between the parallel portions of the bracket but also between the bottom and the cover of said case, in order to keep the lug 48 in contact with the edge of the tab 39, 40 which is co-planar thereto.

The lug 48 is crossed by a diametrical hole 50. At the level of said hole, the case 2 is provided with a notch 51 indented in the bottom 6, the perimetric wall being opposite to the plate 8 and the cover 3. By inserting a dowel 52 into the hole 50 it is possible to rotate the small cylinder 46 by 180° and move the lug 48 from a position in which it is in contact with the tab of one hub to a position in which it is in contact with the tab of the other hub. In this manner, one of the tabs 39 and 40 is located at the chamfer 49 and is thus not subjected to the action of the spring 45.

Figure 4:
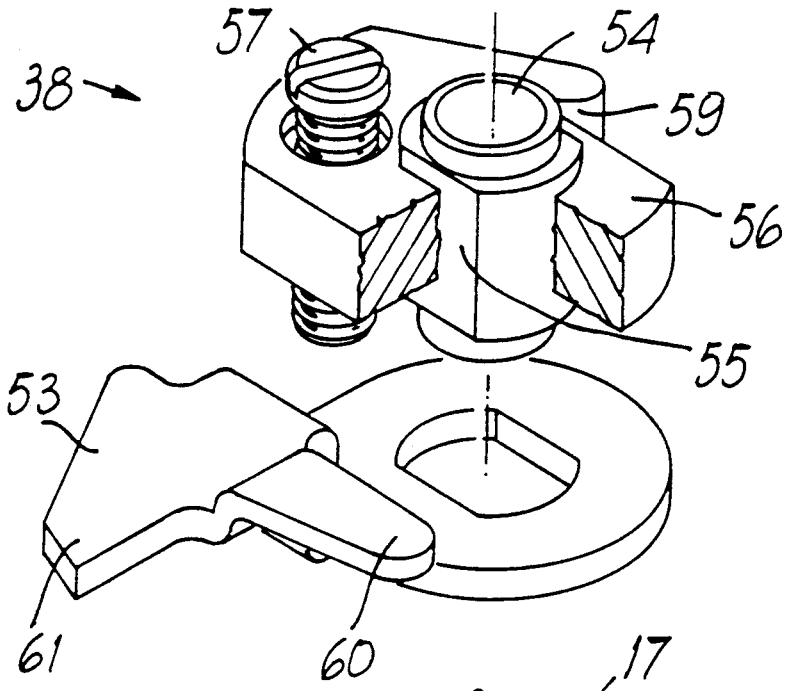
FIG. 4 is an exploded perspective view of the bolt retraction device; and finally
Figure 5:
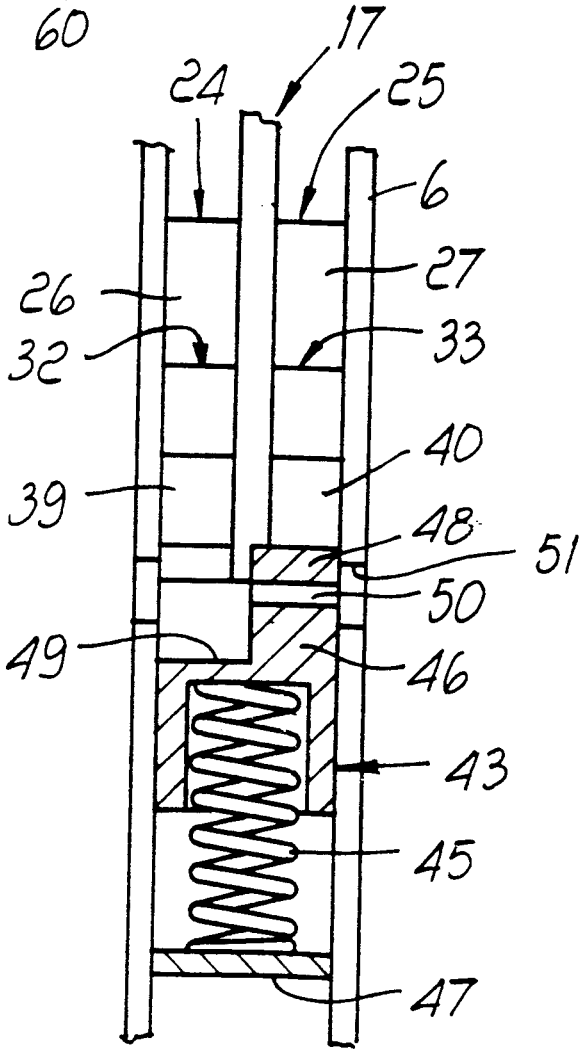
FIG. 5 is a sectional view, taken along the plane V—V of FIG. 2.

The device 38 which allows the simultaneous actuation of the spring-latch and of the bolt is shown in FIG. 4. Said device comprises a lever 53 having a composite profile, from which a bush-like pin 54 protrudes; said pin is provided with flat portions 55 and is rotatably supported in seats of the bottom 6 and of the cover 3. A plate 56 is rotationally coupled on the pin 54 and can be moved with respect to the lever 53 by means of a set screw 57 which is screwed in the plate 56 and can be accessed through a hole 58 of the cover 3 of the case.

The set screw 57 has its threaded end in contact with the lever 53 and its head in contact with the inner face of the cover 3, so that it is axially locked but can rotate in order to allow the movement of the plate 56 along the pin 54.

A shoulder 59 is peripherally defined in the plate 56 and in a position to interfere with the abutment 36 or 37, depending on whether the plate 56 is arranged co-planar to the hub 22 or to the hub 23.

The lever 53 is provided with a flap 60 and an end 61 for releasing and respectively pulling the bolt of the lock during opening.

The bolt 10 has (see FIG. 2) a tang 62 which is guided, by means of a slot 63, on a square pin 64 which is fixed to the bottom 6 of the case. The pin 64 acts not only as guiding element but also as locking element for the bolt.

Said pin in fact cooperates with a tooth 65 of a plate-like pawl 66 which is supported by the tang 62 and is guided transversely thereto by the engagement of the two wings 67 and 68 of the pawl in respective slots of the tang.

The pawl 66 is actuated by a spring 69 which abuts with one side on a tab of the tang and acts with the other side on the wing 68, so as to keep the tooth 65 in the position for locking the pin 64.

In order to release the bolt, the pawl 66 is actuated by means of the lever 53 or known key cylinder which is suitable to be accommodated in a seat 70.

The lever 53, with its flap 60, acts on the pawl 66 by means of a ratchet 71 which is pivoted on the tang 62 by means of a pin 72. The ratchet is L-shaped, one arm of which can be engaged by the flap 60 of the lever 53 while the other arm acts on the tooth 68 in contrast with the action of the spring 69.

Provisions are made, in the illustrated lock, to increase the stroke of the bolt 10 with respect to the stroke of the tang 62. For this purpose, the bolt 10 and the tang 9 are crossed by two dowels 73 and 74: the first dowel is rigidly coupled to the tang and slides in a longitudinal slot 75 and 76 of the bolt and of the case; the second dowel is instead rigidly coupled to the bolt and slides in a slot 77 of the tang.

The end of a connecting rod 78 is articulated to the dowel 74; said rod is oscillatably supported on a pin 79 which is fixed to the bottom 6 of the case. A spring 80 acts on the connecting rod 78 and rests on a lobe 81 which protrudes from the bottom 6 and is capable of cooperating with the traction force applied to the tang during opening. A slot is defined in the connecting rod 78 in a median position between the dowel 74 and the pin 79 and is occupied by the dowel 73.

Thus, when the tang 62 performs its opening or closing stroke, the bolt performs a stroke which is increased proportionally to the ratio between the length of the arms of the dowels 73 and 74 with respect to the fulcrum 79 and is such as to produce a greater protrusion of the bolt from the case and a safer engagement of the seat intended to receive it.

Figure 2:
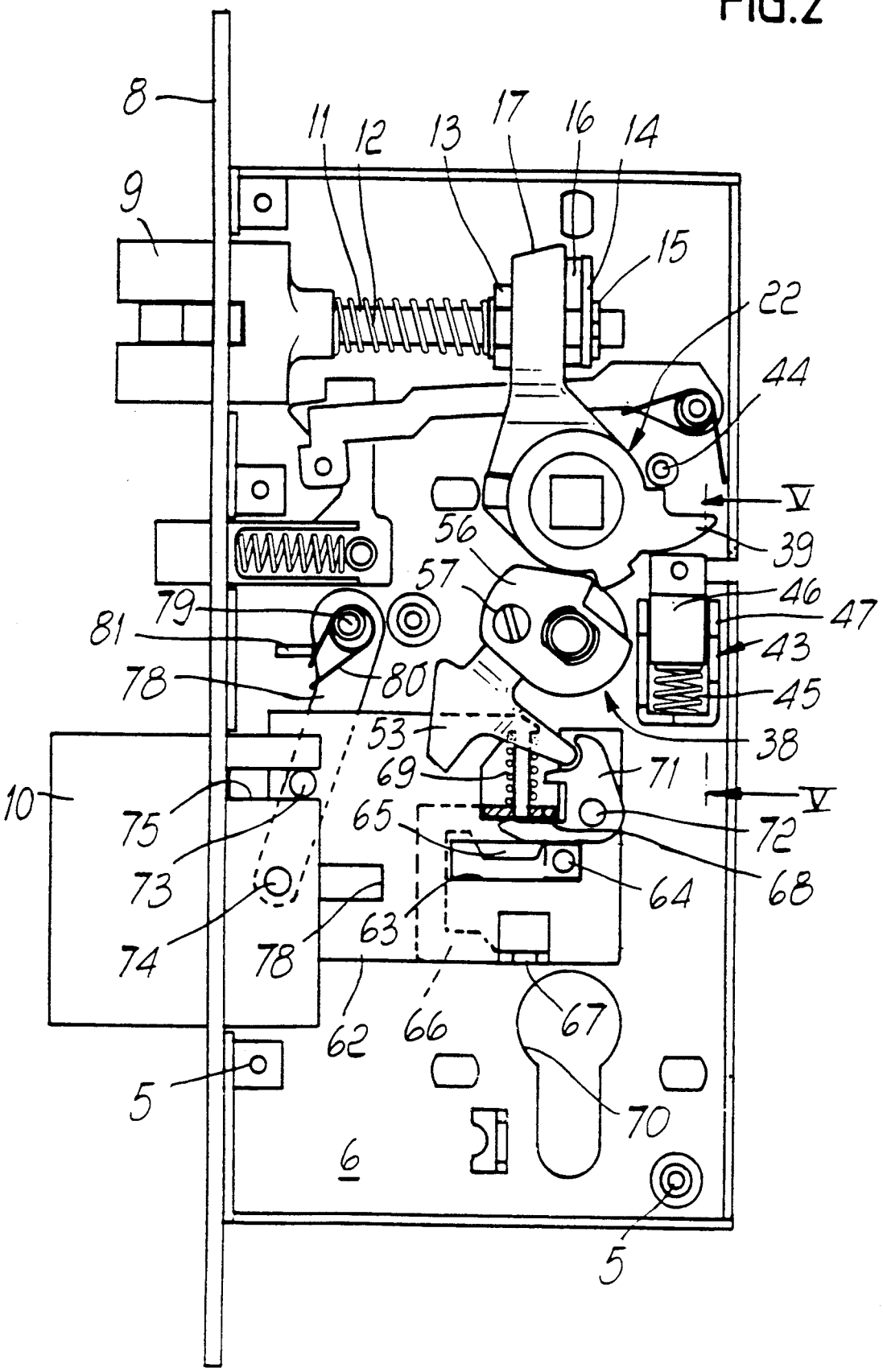
FIG. 2 is a view of the internal elements of the lock when the bolt is in the locking position.

The operation of the lock is as follows. Assume that the visible side of the lock, as shown in FIG. 2, is the inner one, for which there is a handle for the actuation of the spring-latch 9 and for the rapid opening of the bolt. A knob is instead provided on the outer side and obviously is not able to actuate the spring-latch. However, the bolt can be actuated both from the outside and from the inside by means of the key-operated cylinder.

In these conditions, the cylinder 46 is orientated so that the lug 48 acts on the beak 39 of the inner hub 22, whereas the plate 56 is arranged in the plane of said hub 22. Therefore, by actuating the inner handle, the hub 22 is rotated in contrast with the return spring 45. Upon rotation of the hub 22, the tooth 34 abuts against the tooth 19 of the opening lever 17, causing the retraction of the spring-latch 9. Simultaneously, the abutment 36 acts on the shoulder 59 of the plate 56, which by being rotationally coupled to the lever 53 cause the rotation of said plate 56 about the pin 54. In a first portion of said rotation, the lever 53, by means of the flap 60, causes the rotation of the ratchet 71, which raises the pawl 66. In a second portion of its rotation, the lever 53 opens the bolt by pushing with the end 61 on the wing 68 which protrudes from the face of the tang 62.

Essentially, the actuation of the handle allows the immediate opening of the lock without having to act on the key-operated cylinder.

If one wishes to open the lock from outside, first of all the bolt is retracted by means of the key-operated cylinder and then the knob is turned so that the hub 23 with the tooth 35 can act on the lever 17, causing the spring-latch to retract. It should be noted that the rotation of the knob does not entail the compression of the return spring 45 but only of the spring 12 of the spring-latch, so that the user has to perform a smaller effort, since the beak 40 of the hub 23 is arranged in front of the chamfer 49 and can rotate freely. In comparison, the greater effort to be applied to the handle in order to cop with the return force of the spring 45 is allowed by the longer lever arm offered by the handle.

If the lock must be mounted in the opposite direction to the one described above, i.e. with the knob engaged in the hub 22, it is possible to restore the same operating conditions by rotating the small cylinder 46 by 180°, by means of the dowel 52 inserted in the hole 50 and by screwing the screw 57 so as to move the plate 56 into the same plane as the hub 23. In this manner, the knob can actuate only the spring-latch and the handle can actuate both the spring-latch and the bolt by means of the hub 23 and the device 38.

A substantial advantage of the present invention is constituted by the fact that the same lock can be used, after a few simple adjustments, for right-swing doors and for left-swing doors, thus providing a considerable technological saving, especially as regards preparation of equipment and of stock.

I claim:

1. Lock comprising a spring-latch and a bolt, said spring-latch being actuatable against the biasing action of a spring by means of an external lever (knob) or an internal lever (handle), said levers being rotationally rigidly coupled to respective coaxial hubs which are rotatably supported at the sides of an element for opening the spring-latch which is pivoted coaxially to said hubs and is intermediate thereto, said lock further comprising teeth for pulling said element which are defined on said hubs and are suitable to pull said element only in the direction for opening the spring-latch by actuating one of said levers, means for the elastic return of said hubs when said levers are released, said means being composed of a spring which acts on tabs of said hubs with the interposition of a block which is guided tangentially to said hubs, said block being orientatable and shaped so as to provide abutment only to the tab of the hub to which the inner lever is rigidly coupled, and further comprising a device for the retraction of the bolt from its closure position which comprises a lever which is articulated about an axis which is parallel to the axis of said hubs and has an end which is suitable to engage said bolt and a plate which is rotationally coupled to said lever and is provided with setting means, in order to position it in the plane of the hub to which the inner lever is coupled, and with a shoulder which is suitable to interfere with an abutment defined on said hubs.

2. Lock according to claim 1, wherein said block is constituted by a small cylinder on one end of which a spring acts, the opposite end being instead provided with a lug which is adjacent to a chamfer, said lug being engaged on the tab of the hub to which the inner lever is rigidly coupled, said chamfer being arranged opposite to the tab of the hub of the outer lever.

3. Lock according to claim 2, wherein said plate is rotationally coupled to, but can slide axially on, a pin which is rigidly coupled to said lever and acts as articulation thereof, a set screw being screwed in said plate, said screw abutting on said lever in order to move said plate with respect to said lever in said position in which the shoulder of said plate is suitable to interfere with the abutments of said hubs.

* * * * *